US011358016B1

(12) United States Patent
Johnson

(10) Patent No.: US 11,358,016 B1
(45) Date of Patent: Jun. 14, 2022

(54) FIRE SPRINKLER WITH INTEGRATED SHUT OFF VALVE

(71) Applicant: Eric Johnson, Oregon City, OR (US)

(72) Inventor: Eric Johnson, Oregon City, OR (US)

( * ) Notice: Subject to any disclaimer, the term of this patent is extended or adjusted under 35 U.S.C. 154(b) by 0 days.

(21) Appl. No.: 16/273,279

(22) Filed: Feb. 12, 2019

(51) Int. Cl.
*A62C 37/20* (2006.01)
*A62C 35/68* (2006.01)
*A62C 37/12* (2006.01)

(52) U.S. Cl.
CPC ..... *A62C 37/20* (2013.01); *A62C 35/68* (2013.01); *A62C 37/12* (2013.01)

(58) Field of Classification Search
CPC ..... A62C 37/20; A62C 35/68; A62C 37/12; A62C 37/14
USPC ..... 169/38, 41, 90
See application file for complete search history.

(56) References Cited

U.S. PATENT DOCUMENTS 2,700,423 A 1/1955 Burkert
D251,128 S 2/1979 Groos
5,560,430 A 10/1996 Enos
7,743,838 B2 6/2010 Wilson
8,387,712 B2 3/2013 Flynn
2006/0042803 A1 3/2006 Gallaher
2017/0043195 A1 2/2017 Hughes

FOREIGN PATENT DOCUMENTS

WO 2006026675 5/2007

*Primary Examiner* — Christopher S Kim
(74) *Attorney, Agent, or Firm* — Howard Russell

(57) ABSTRACT

The sprinkler head with integrated shut-off valve is configured for use in a fire sprinkler system and a water source. The heat generated by a fire automatically actuates the sprinkler head with integrated shut-off valve. The sprinkler head with integrated shut-off valve further comprises a manually operated valve. The manually operated valve closes the sprinkler head with integrated shut-off valve in cases inappropriate actuation. The sprinkler head with integrated shut-off valve comprises a deflector, a heat sensitive release mechanism, a wedge seal, a valve block, and a threaded connection. The threaded connection attaches the sprinkler head with integrated shut-off valve to the water source. The heat sensitive release mechanism and the wedge seal actuate the valve. The deflector directs the water released by the sprinkler head with integrated shut-off valve. The valve block forms the manually operated valve of the sprinkler head with integrated shut-off valve.

18 Claims, 4 Drawing Sheets

FIRE SPRINKLER WITH INTEGRATED SHUT OFF VALVE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of life-saving and firefighting equipment, more specifically, a permanently installed device for the control of firefighting equipment.

SUMMARY OF INVENTION

The sprinkler head with integrated shut-off valve is configured for use in a fire suppression system. The sprinkler head with integrated shut-off valve is configured for use in a fire sprinkler system. The sprinkler head with integrated shut-off valve is configured for use with a water source. The sprinkler head with integrated shut-off valve is a normally closed valve. The sprinkler head with integrated shut-off valve is an automatically operated valve. The heat generated by a fire actuates the sprinkler head with integrated shut-off valve. When actuated, the sprinkler head with integrated shut-off valve releases water from the water source. The sprinkler head with integrated shut-off valve further comprises a manually operated valve. The manually operated valve mechanically closes the sprinkler head with integrated shut-off valve in cases where the sprinkler head with integrated shut-off valve actuates inappropriately. The sprinkler head with integrated shut-off valve comprises a deflector, a heat sensitive release mechanism, a wedge seal, a valve block, and a threaded connection. The threaded connection attaches the sprinkler head with integrated shut-off valve to the water source. The heat sensitive release mechanism and the wedge seal actuate the valve. The deflector directs the water released by the sprinkler head with integrated shut-off valve. The valve block forms the manually operated valve of the sprinkler head with integrated shut-off valve.

These together with additional objects, features and advantages of the sprinkler head with integrated shut-off valve will be readily apparent to those of ordinary skill in the art upon reading the following detailed description of the presently preferred, but nonetheless illustrative, embodiments when taken in conjunction with the accompanying drawings.

In this respect, before explaining the current embodiments of the sprinkler head with integrated shut-off valve in detail, it is to be understood that the sprinkler head with integrated shut-off valve is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the sprinkler head with integrated shut-off valve.

It is therefore important that the claims be regarded as including such equivalent construction insofar as they do not depart from the spirit and scope of the sprinkler head with integrated shut-off valve. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
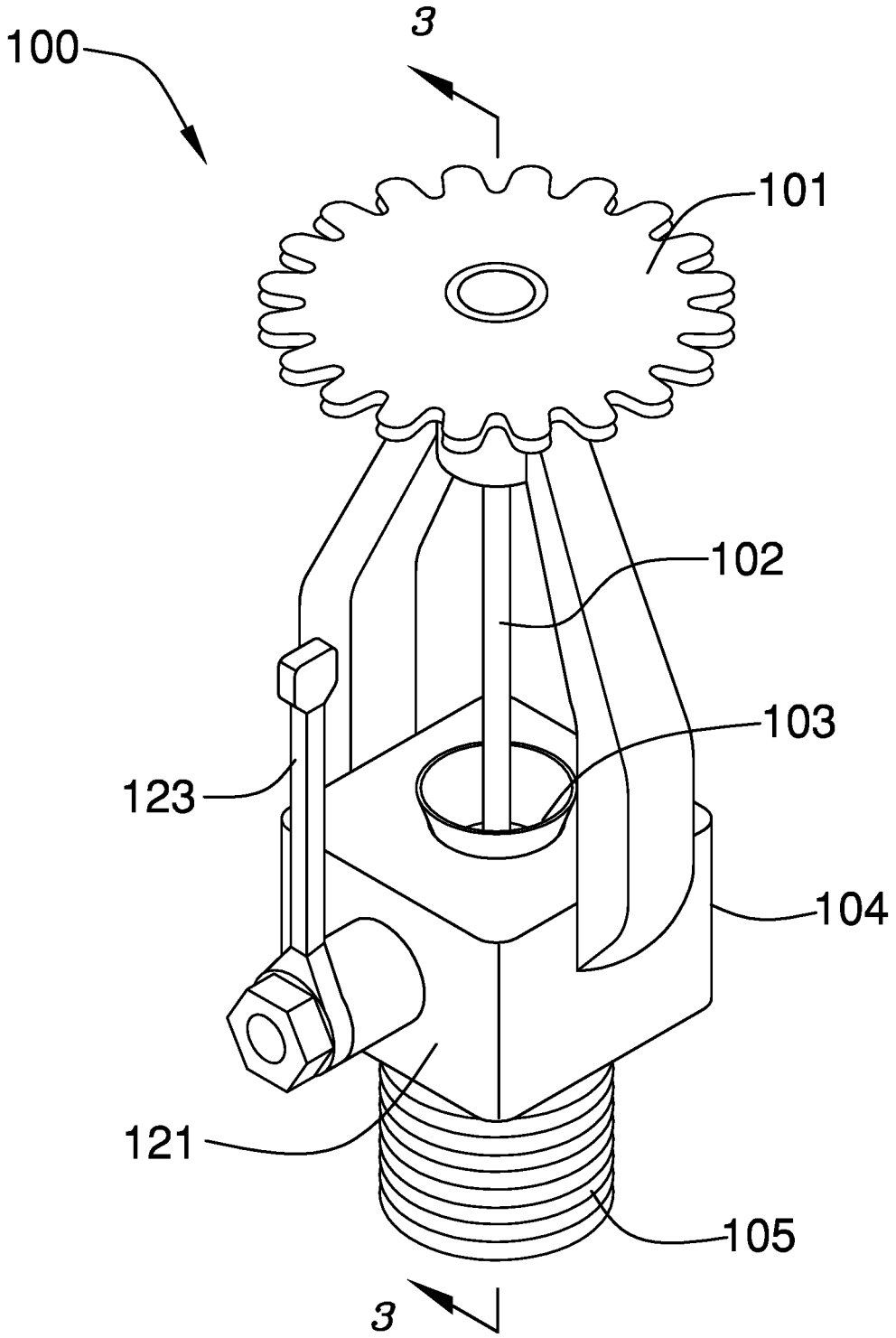
FIG. 1 is a perspective view of an embodiment of the disclosure.
Figure 2:
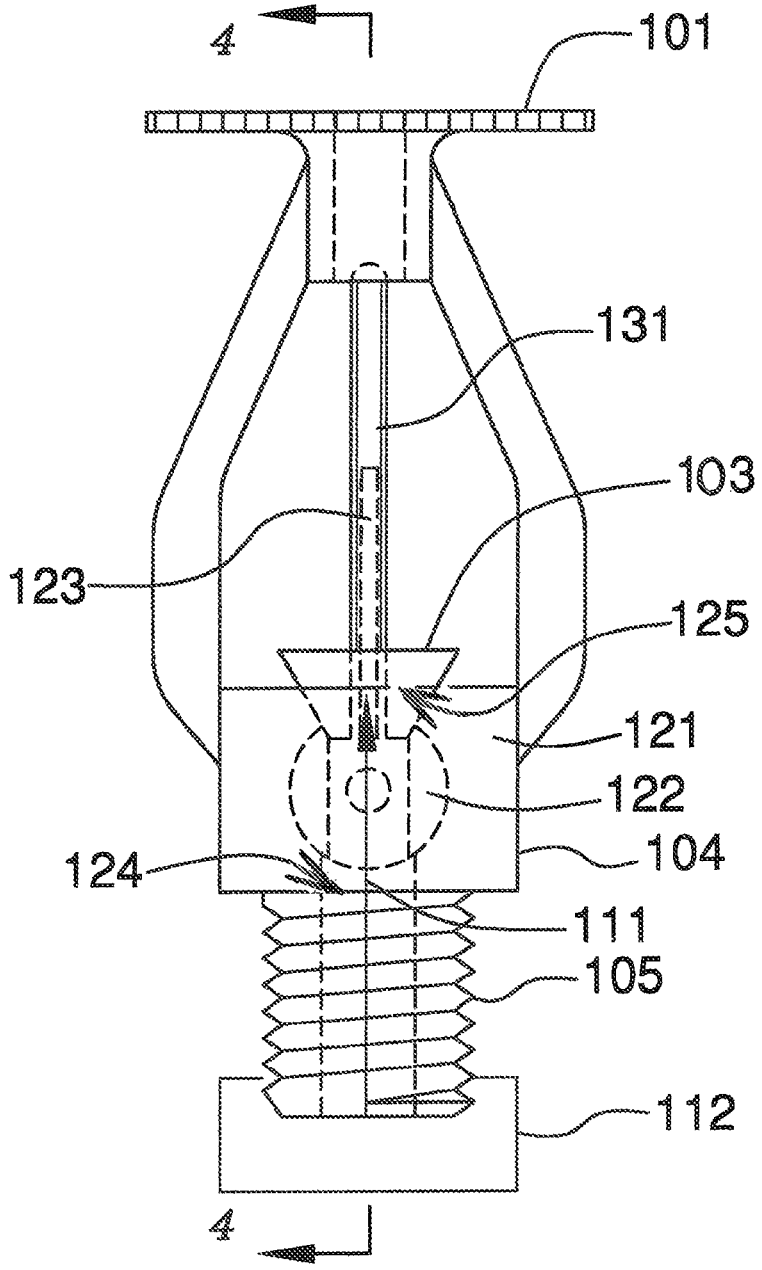
FIG. 2 is a side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The sprinkler head with integrated shut-off valve 100 (hereinafter invention) is configured for use in a fire suppression system. The invention 100 is configured for use in a fire sprinkler system. The invention 100 is configured for use with a water source 112. The invention 100 is a normally closed valve. The invention 100 is an automatically operated valve. The heat generated by a fire actuates the invention 100. When actuated, the invention 100 releases water from the water source 112.

The invention 100 further comprises a manually operated valve. The manually operated valve mechanically closes the invention 100 in cases where the invention 100 actuates inappropriately. The invention 100 comprises a deflector 101, a heat sensitive release mechanism 102, a wedge seal 103, a valve block 104, and a threaded connection 105. The threaded connection 105 attaches the invention 100 to the water source 112. The heat sensitive release mechanism 102 and the wedge seal 103 actuate the valve. The deflector 101 directs the water released by the invention 100. The valve block 104 forms the manually operated valve of the invention 100.

The invention 100 forms a flow channel 111. The flow channel 111 is a cylindrical structure that is formed in the invention 100. The flow channel 111 transports water from the water source 112 of the sprinkler system through the threaded connection 105 and the valve block 104 to the water discharge 125. When the wedge seal 103 is released by the heat sensitive release mechanism 102, the water is released from the flow channel 111 through the water discharge 125 of the valve block 104 to the deflector 101.

The invention 100 is configured for use with a water source 112 in the form of the sprinkler system. The invention 100 passes water from the water source 112 to the deflector 101, which then disperses the water to what is presumed to be a fire.

The deflector 101 is a plate structure. The deflector 101 is placed in line with the flow channel 111 and the water discharge 125 of the valve block 104. The water discharged from the valve block 104 is routed directly on to the deflector 101 such that the deflector 101 will deflect the water flow into a previously determined direction. The deflector 101 is a rotating device. The rotation of the deflector 101 atomizes the released water into a spray that allows the invention 100 to more efficiently suppress a fire. The use of a deflector 101 on a sprinkler head is well-known and documented among fire suppression professionals.

The heat sensitive release mechanism 102 is a heat sensitive structure that actuates the invention 100 in an emergency situation. Under normal conditions, the heat sensitive release mechanism 102 holds the wedge seal 103 over the water discharge 125 of the valve block 104 to keep the invention 100 in the normally closed valve position of the invention 100. When the heat sensitive release mechanism 102 reaches a previously determined actuation temperature, the heat sensitive release mechanism 102 fails such that the wedge seal 103 is released thereby allowing water to flow from the valve block 104 to the deflector 101 for distribution. The use of a heat sensitive release mechanism 102 on a sprinkler head is well-known and documented among fire suppression professionals.

The heat sensitive release mechanism 102 is selected from the group consisting of a fused metal link and a glass bulb sensor 131. In the first potential embodiment of the disclosure, the heat sensitive release mechanism 102 is a glass bulb sensor 131.

The wedge seal 103 is a solid structure. The wedge seal 103 is a metal structure. The metal selected for the wedge seal 103 has a melting point above the previously determined actuation temperature of the heat sensitive release mechanism 102. The wedge seal 103 is formed in the shape of a truncated cone. The shape of the wedge seal 103 allows the wedge seal 103 to insert into the water discharge 125 of the valve block 104.

When secured in position by the heat sensitive release mechanism 102, the wedge seal 103 prevents the discharge of water from the valve block 104 to the deflector 101. When the temperature of the heat sensitive release mechanism 102 reaches the previously determined actuation temperature, the heat sensitive release mechanism 102 fails according to its design and releases the securing pressure applied to the wedge seal 103.

The release of the wedge seal 103 by the heat sensitive release mechanism 102 causes the wedge seal 103 to fall away from the water discharge 125 of the valve block 104 thereby allowing water to discharge from the water discharge 125 of the valve block 104 to the deflector 101.

The use of a wedge seal 103 on a sprinkler head is well-known and documented among fire suppression professionals.

The valve block 104 is a manually operated valve installed in the flow channel 111 of the invention 100. The valve block 104 provides a mechanism to close an instantiation of the invention 100 that has been inappropriately actuated without requiring the entire sprinkler system to be deactivated.

In the first potential embodiment of the disclosure, the valve block 104 is a ball valve 122. The valve block 104 is normally installed in the invention 100 in an open position that allows water to pass through the invention 100. The valve block 104 comprises a housing 121, a ball valve 122, and a lever 123.

The valve block 104 is further defined with a water inlet 124 and a water discharge 125. The water inlet 124 is a port that receives water from the water source 112 provided by the sprinkler system. The threaded connection 105 attaches the water inlet 124 to the water source 112. The water discharge 125 is a port that receives water from the valve block 104 to the deflector 101.

Figure 4:
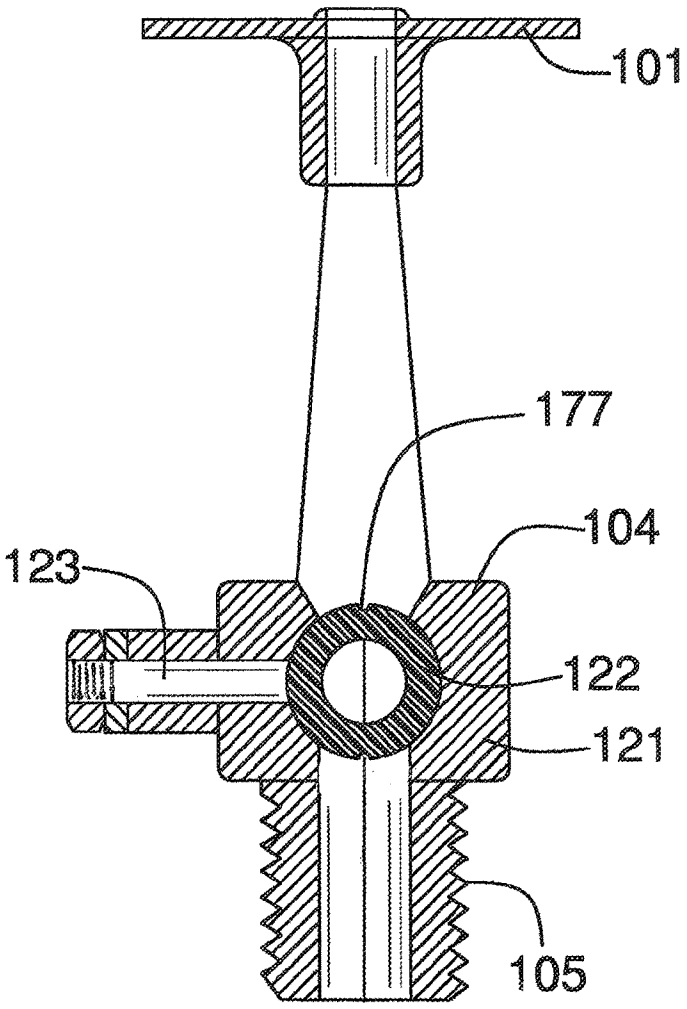
FIG. 4 is a cross-sectional view of an embodiment of the disclosure across 4-4 as shown in FIG. 2.
Figure 3:
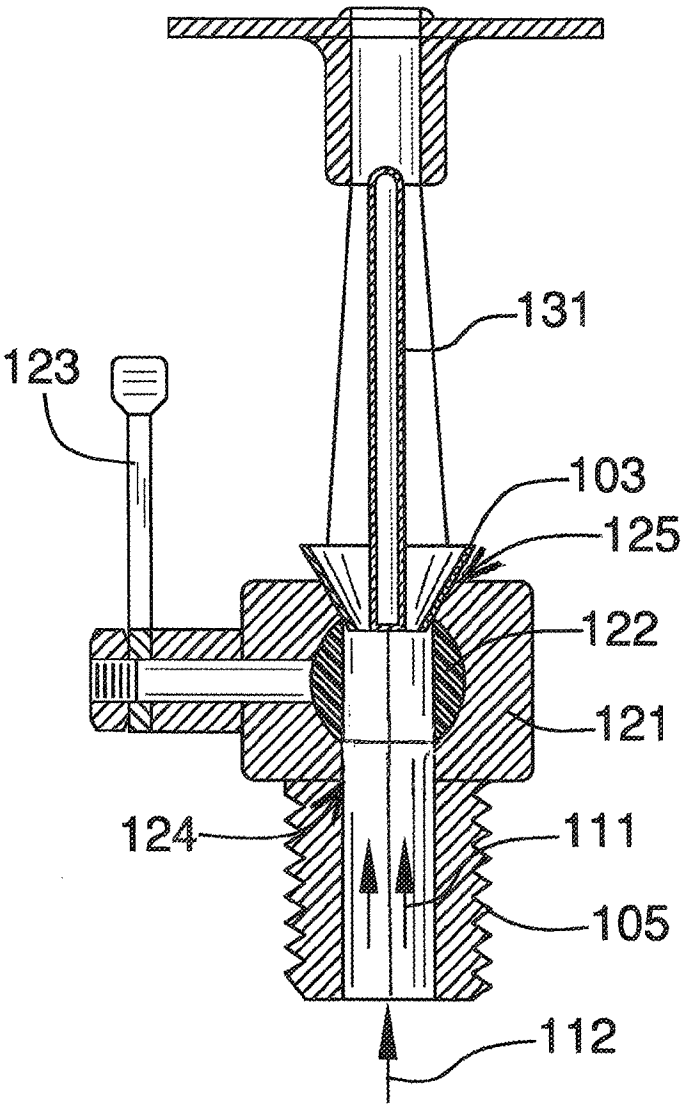
FIG. 3 is a cross-sectional view of an embodiment of the disclosure across 3-3 as shown in FIG. 1.

The ball valve 122 includes a ring groove 177. The ring groove 177 partially encircles along an outer surface of the ball valve 122. Referring to FIG. 4, the ring groove 177 is visible when the wedge seal 103 has fallen away. When the valve block 104 is closed, the ring groove 177 enables a small amount of water (typically a continuous release of water drops) to exit the valve block 104. This capability enables a technician to ascertain that the valve block 104 is closed. The ring groove 177 extends between the water inlet 124 and the water discharge 125 to enable the small amount of water to exit when the ball valve is in a closed position.

Figure 5:
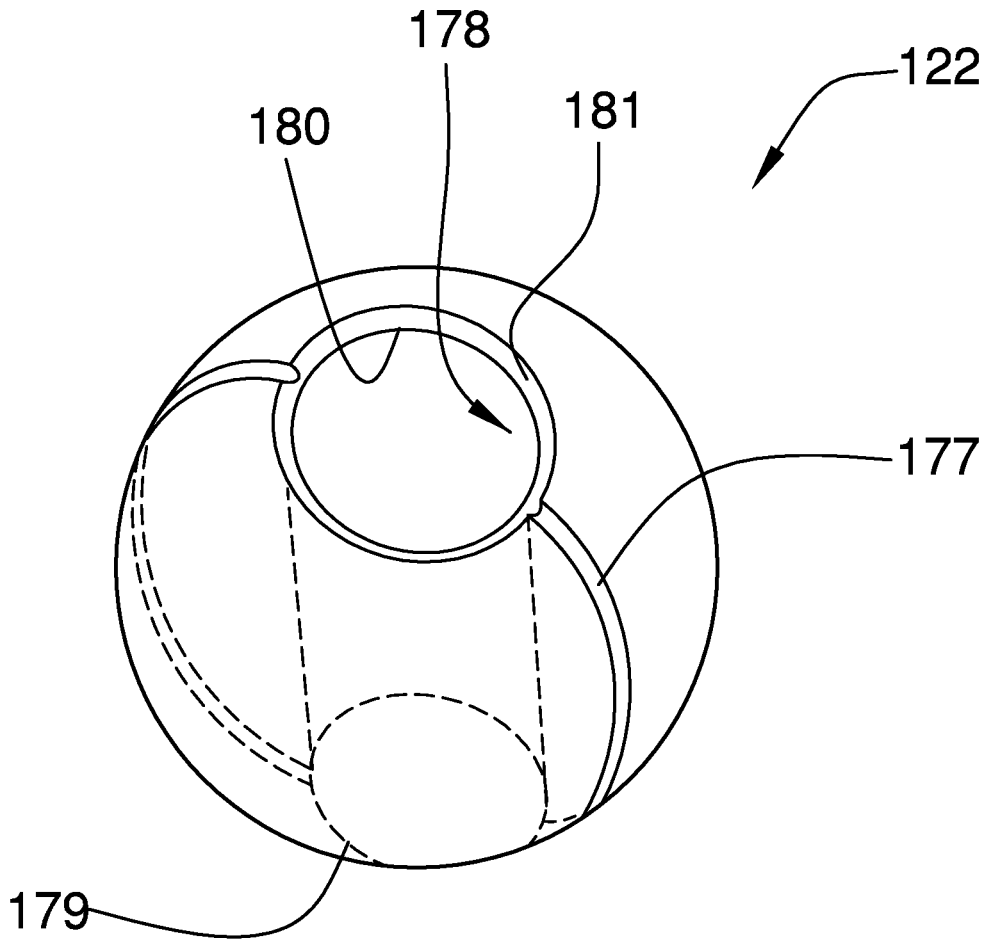
FIG. 5 is a detail view of the ball valve.

Referring to the ball valve 122 in FIG. 5, the ball valve 122 is a sphere with a channel 178 that extends through the center of the ball valve 122. The channel 178 is further defined with a channel inlet 179 and a channel outlet 180. The channel inlet 179 is adjacent with the water inlet 124 of the valve block 104; where the channel outlet 180 is adjacent the water discharge 125 of the valve block 104. The ring groove 177 extends along opposing sides of the ball valve 122. More specifically, the ring groove 177 extends along an outer surface of the ball valve 122 from the channel inlet 179 and the channel outlet 180. Also, it shall be noted that the channel outlet 180 may have a shoulder 181 to recess the channel outlet 180 from the outer surface of the ball valve 122. The shoulder 181 aids in proper alignment and seating of the wedge seal 103.

The housing 121 is a rectangular block structure that attaches to the threaded connection 105. The housing 121 is a rigid structure. The housing 121 contains the ball valve 122. The housing 121 is formed with all apertures and form factors necessary to allow the housing 121 to accommodate the use and operation of the invention 100. The housing 121 contains the ball valve 122. The lever 123 mounts on the housing 121.

The ball valve 122 is a well-known and documented type of valve. The ball valve 122 controls the flow of water through the ball valve 122 from the water inlet 124 to the water discharge 125. The lever 123 is a manually operated shaft. The lever 123 rotates around a pivot. The rotation of the lever 123 opens and closes the ball valve 122.

The threaded connection 105 is a hollow tube that is further formed with an exterior screw thread. The threaded connection 105 attaches the valve block 104 to the water source 112 provided by the sprinkler system. The threaded connection 105 screws into an interior screw thread provisioned by the sprinkler system. The use of a threaded connection 105 with a sprinkler head is well-known and documented among fire suppression professionals.

The following definitions were used in this disclosure:

Ball Valve: As used in this disclosure, a ball valve is a type of valve. The flow of a fluid through a ball valve is controlled using a spherical structure with a cylindrical channel formed through it. When the center axis of the cylindrical channel aligns with the center axis of the flow path of the ball valve, fluid will flow through the ball valve. When the center axis of the cylindrical channel is perpendicular to the center axis of the flow path of the ball valve, fluid will not flow through the ball valve.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Channel: As used in this disclosure, a channel is a tubular passage through which an object or fluid is passed through.

Cone: As used in this disclosure, a cone is a surface generated by rotating a triangle around one of the legs of the triangle. If a line that is perpendicular to the base that is drawn from the center of the base goes through the vertex of the triangle then the cone is called a right cone. A cone is a type of quadric surface. The cone is a pyramid with a circular base. The cone is further defined with an apex, a base, and a lateral face.

Cylinder: As used in this disclosure, a cylinder is a geometric structure defined by two identical flat and parallel ends, also commonly referred to as bases, which are circular in shape and connected with a single curved surface, referred to in this disclosure as the lateral face. The cross-section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Exterior Screw Thread: An exterior screw thread is a ridge wrapped around the outer surface of a tube in the form of a helical structure that is used to convert rotational movement into linear movement.

Form Factor: As used in this disclosure, the term form factor refers to the size and shape of an object.

Interior Screw Thread: An interior screw thread is a groove formed around the inner surface of a tube in the form of a helical structure that is used to convert rotational movement into linear movement.

Housing: As used in this disclosure, a housing is a rigid casing that encloses and protects one or more devices.

Lever: As used in this disclosure, a lever is a simple machine that comprises a shaft that rotates around a fulcrum or pivot point.

Screw: As used in this disclosure, to screw is a verb meaning: 1) to fasten or unfasten (unscrew) a threaded connection; or 2) to attach a helical structure to a solid structure.

Threaded Connection: As used in this disclosure, a threaded connection is a type of fastener that is used to join a first tube-shaped and a second tube-shaped object together. The first tube-shaped object is fitted with a first fitting selected from an interior screw thread or an exterior screw thread. The second tube-shaped object is fitted with the remaining screw thread. The tube-shaped object fitted with the exterior screw thread is placed into the remaining tube-shaped object such that: 1) the interior screw thread and the exterior screw thread interconnect; and, 2) when the tube-shaped object fitted with the exterior screw thread is rotated the rotational motion is converted into linear motion that moves the tube-shaped object fitted with the exterior screw thread either into or out of the remaining tube-shaped object. The direction of linear motion is determined by the direction of rotation.

Truncated: As used in this disclosure, a geometric object is truncated when an apex, vertex, or end is cut off by a line or plane.

Truncated Cone: As used in this disclosure, a truncated cone is a frustum that remains when the apex of a cone is truncated by a plane that is parallel to the base of the cone.

Valve: As used in this disclosure, a valve is a device that is used to control the flow of a fluid (gas or liquid) through a pipe.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An element of a fire safety system comprising:

a deflector, a heat sensitive release mechanism, a wedge seal, a valve block, and a threaded connection;

wherein the threaded connection is configured to attach to a water source;

wherein the heat sensitive release mechanism and the wedge seal are adapted to actuate water flow through the valve block;

wherein the deflector directs the water flow of the water source released by the element of the fire safety system;

wherein the valve block controls the water flow through the element of the fire safety system;

wherein the element of the fire safety system is a normally closed valve;

wherein the element of the fire safety system is an automatically operated valve;

wherein heat actuates the element of the fire safety system;

wherein the element of the fire safety system releases the water flow from the water source;

wherein the valve block comprises a housing, a ball valve, and a lever;

wherein the valve block is further defined with a water inlet and a water discharge;

wherein the ball valve controls the water flow through the ball valve from the water inlet to the water discharge;

wherein the ball valve includes a ring groove;

wherein the ring groove partially encircles along an outer surface of the ball valve;

wherein when the valve block is closed, the ring groove enables an at least one droplet of water from the water source to exit the valve block;

wherein the ring groove extends between the water inlet and the water discharge to enable the at least one droplet of water from the water source to exit when the ball valve is in a closed position.

2. The element of the fire safety system according to claim 1 wherein the element of the fire safety system comprises a flow channel;

wherein the flow channel is a cylindrical structure;

wherein the flow channel transports the water flow from the water source-through the threaded connection and the valve block.

3. The element of the fire safety system according to claim 2 wherein the wedge seal is released by the heat sensitive release mechanism to release water flow through the flow channel.

4. The element of the fire safety system according to claim 3 wherein the element of the fire safety system passes water to the deflector;

wherein the deflector disperses the water;

wherein the deflector is a plate structure;

wherein the deflector is placed in line with the flow channel.

5. The element of the fire safety system according to claim 4 wherein the deflector is a rotating device;

wherein the rotation of the deflector atomizes the released water into a spray;

wherein the heat sensitive release mechanism is a heat sensitive structure;

wherein the heat sensitive release mechanism actuates the element of the fire safety system.

6. The element of the fire safety system according to claim 5 wherein the heat sensitive release mechanism attaches to the wedge seal;

wherein the heat sensitive release mechanism rests against the valve block.

7. The element of the fire safety system according to claim 6 wherein the heat sensitive release mechanism fails at a previously determined temperature;

wherein the failure of the heat sensitive release mechanism releases the wedge seal such that the water flows from the valve block to the deflector.

8. The element of the fire safety system according to claim 7 wherein the heat sensitive release mechanism is selected from the group consisting of a fused metal link and a glass bulb sensor.

9. The element of the fire safety system according to claim 8 wherein the wedge seal is a solid structure;

wherein the wedge seal is a metal structure;

wherein the wedge seal is formed in the shape of a truncated cone.

10. The element of the fire safety system according to claim 9 wherein the valve block is a manually operated valve.

11. The element of the fire safety system according to claim 10 wherein the valve block forms a mechanism to close an instantiation of the element of the fire safety system that has been actuated.

12. The element of the fire safety system according to claim 11 wherein the wedge seal inserts into the water discharge of the valve block.

13. The element of the fire safety system according to claim 12 wherein the threaded connection is adapted to attach the water inlet to a water source.

14. The element of the fire safety system according to claim 13 wherein the housing is a rectangular block structure;

wherein the housing is a rigid structure;

wherein the housing contains the ball valve;

wherein the lever mounts on the housing.

15. The element of the fire safety system according to claim 14 wherein the lever is a manually operated shaft;

wherein the lever rotates around a pivot;

wherein the rotation of the lever opens and closes the ball valve.

16. The element of the fire safety system according to claim 15 wherein the ball valve is a sphere with a channel that extends through the center of the ball valve;

wherein the channel is further defined with a channel inlet and a channel outlet;

wherein the ring groove extends along opposing sides of the ball valve;

wherein the ring groove extends along the outer surface of the ball valve from the channel inlet to the channel outlet;

wherein the channel outlet is further defined with a shoulder from the ball valve;

wherein the shoulder recesses the channel outlet from the outer surface of the ball valve;

wherein the shoulder aids in proper alignment and seating of the wedge seal.

17. The element of the fire safety system according to claim 16 wherein the metal selected for the wedge seal has a melting point above the previously determined actuation temperature of the heat sensitive release mechanism.

18. The element of the fire safety system according to claim 17 wherein when the temperature of the heat sensitive release mechanism reaches the previously determined actuation temperature, the heat sensitive release mechanism fails and releases a securing pressure applied to the wedge seal;

wherein the release of the wedge seal by the heat sensitive release mechanism causes the wedge seal to fall away from the water discharge of the valve block thereby allowing the water of the water source to discharge from the water discharge of the valve block to the deflector.

* * * * *